US008480411B1

(12) United States Patent
Ho et al.

(10) Patent No.: US 8,480,411 B1
(45) Date of Patent: Jul. 9, 2013

(54) ELECTRICAL CONNECTOR AND ELECTRICAL ASSEMBLY

(75) Inventors: San-Chi Ho, Taoyuan County (TW); Mei-Ju Kou, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 13/409,124

(22) Filed: Mar. 1, 2012

(51) Int. Cl.
*H01R 12/00* (2006.01)

(52) U.S. Cl.
USPC ..... 439/79

(58) Field of Classification Search
USPC ..... 439/59, 79–83
See application file for complete search history.

(56) References Cited

U.S. PATENT DOCUMENTS

| | | | | |
|---|---|---|---|---|
| 5,993,224 | A * | 11/1999 | Quillet et al. | 439/79 |
| 6,761,566 | B2 | 7/2004 | Chen et al. | |
| 2012/0083141 | A1* | 4/2012 | Molnar et al. | 439/82 |
| 2012/0295454 | A1* | 11/2012 | Jiang et al. | 439/83 |

* cited by examiner

*Primary Examiner* — James Harvey
(74) *Attorney, Agent, or Firm* — Jianq Chyun IP Office

(57) ABSTRACT

An electrical assembly including a circuit board having a front surface, a rear surface, pin holes, an accommodating opening and a positioning opening and an electrical connector having a body and pins is provided. The body accommodated in the accommodating opening has a plug hole and a positioning block. The pins extend from the body and pass the pin holes separately. When the pins pass the pin holes from the front surface, the positioning block is accommodated in the positioning opening and a distance between the plug hole and the front surface is a predetermined distance. When the pins pass the pin holes from the rear surface, the positioning block props against the rear surface and a distance between the plug hole and the front surface is the predetermined distance. An electrical assembly including a combined circuit board to unify the assembling process of components is also provided.

19 Claims, 7 Drawing Sheets

ELECTRICAL CONNECTOR AND ELECTRICAL ASSEMBLY

BACKGROUND OF THE INVENTION

1. Field of the Invention

The disclosure relates to an electrical connector and an electrical assembly. More particularly, the disclosure relates to an electrical connector and an electrical assembly in which technique of "Dip Pin" is used.

2. Description of Related Art

With the continuous advancement and improvement of electronic technology, electronic devices such as mobile phones, tablet computers, notebook computers or the like are extensively used and trend to develop to be convenient, multi-functioned and artistic designed so as to provide much more choices for customers. When demands of digital electronic products are increased, the assembling efficiency of the digital electronic products may become a factor which affects the product price.

As for circuit boards, electronic components can be assembled to the circuit boards by using Dip pin technique, and production lines of the operating process are used to improve high efficiency of mass production. There are several steps in the process when the electronic components are assembled to the circuit board by using Dip Pin technique, including disposing soldering points on through holes of the circuit board, inserting pins of the electronic components having pins into the through holes, and reflowing the circuit board so that the electronic components can be fixed on the circuit board. Therefore, different apparatuses can be disposed on the production lines for performing each required processing step so that the electronic components are assembled to the circuit board.

However, time cost of each of the processing steps performed on the production lines are different, and it may lead to a phenomenon that many apparatuses of the production lines are in an idle status most of the time, and thus production efficiency cannot be effectively improved. Accordingly, simultaneously disposing a plurality of circuit boards and performing assembling process of electronic components on the same substrate or board, or simultaneously disposing a plurality of circuit boards in which adjacent circuit boards are upside down to piece together (mirror board) on the same substrate for performing assembling process of electronic components in front surface and rear surface can improve the production efficiency.

Although assembling process of electronic components by using combining a plurality of circuit boards by disposing the circuit boards upside down can improve the production line efficiency, the manufacturing costs are increased since it has to maintain the circuit boards produced by mass production to be in a constant standard by assembling the electronic components having the same function but different structures to the front surface or rear surface of the circuit boards so that the locations or heights of the electronic components with respect to the circuit boards after assembled can be equalized.

SUMMARY OF THE INVENTION

This disclosure discloses an electrical connector adapted to be installed on a circuit board.

The disclosure further discloses an electrical assembly which can unify the electronic components assembled thereto.

The disclosure further discloses an electrical assembly which can unify the electronic components assembled thereto.

The disclosure provides an electrical connector adapted to be installed on a circuit board. The circuit board has a front surface, a rear surface opposite to the front surface, a plurality of pin holes, an accommodating opening and a positioning opening. The electrical connector includes a body and a plurality of pins. The body is adapted to be accommodated in the accommodating opening of the circuit board and has a plug hole and a positioning block. The pins extend from the body and adapted to pass through the pin holes respectively so as to be soldered to the circuit board, wherein when the pins are inserted from the front surface and pass through the pin holes respectively, the positioning block is accommodated in the positioning opening so that a distance between the plug hole and the front surface of the circuit board is a predetermined distance, and when the pins are inserted from the rear surface and pass through the pin holes respectively, the positioning block is propped against the rear surface so that a distance between the plug hole and the front surface of the circuit board is the predetermined distance.

The disclosure further provides an electrical assembly which includes a circuit board and an electrical connector. The circuit board has a front surface, a rear surface opposite to the front surface, a plurality of pin holes, an accommodating opening and a positioning opening. The electrical connector includes a body and a plurality of pins. The body is accommodated in the accommodating opening of the circuit board and has a plug hole and a positioning block. The pins extend from the body and adapted to pass through the pin holes respectively so as to be soldered to the circuit board, wherein when the pins are inserted from the front surface and pass through the pin holes respectively, the positioning block is accommodated in the positioning opening so that a distance between the plug hole and the front surface of the circuit board is a predetermined distance, and when the pins are inserted from the rear surface and pass through the pin holes respectively, the positioning block is propped against the rear surface so that a distance between the plug hole and the front surface of the circuit board is the predetermined distance.

The disclosure further provides an electrical assembly which includes a combined circuit board, a first electrical connector and a second electrical connector. The combined circuit board includes a first circuit board and a second circuit board. The first circuit board has a first front surface, a first rear surface opposite to the first front surface, a plurality of first pin holes, a first accommodating opening and a first positioning opening. The second circuit board has a second front surface, a second rear surface opposite to the second front surface, a plurality of second pin holes and a second accommodating opening, wherein the second circuit board is upside down with respect to the first circuit board, the first front surface of the first circuit board and the second rear surface of the second circuit are coplanar, the first rear surface of the first circuit board and the second front surface of the second circuit board are coplanar, a circuit of the first circuit board disposed on the first front surface and a circuit of the second circuit board disposed on the second front surface are the same, and a circuit of the first circuit board disposed on the first rear surface and a circuit of the second circuit board disposed on the second rear surface are the same.

The first electrical connector includes a first body and a plurality of first pins. The first body is accommodated in the first accommodating opening of the first circuit board and has a first plug hole and a first positioning block. The first pins extend from the first body and pass through the first pins respectively so as to be soldered on the first circuit board. The second electrical connector, identical to the first electrical connector, includes a second body and a plurality of second pins. The second body is accommodated in the second accommodating opening of the second circuit board and has a second plug hole and a second positioning block. The second pins extend from the second body and pass through the second pins respectively so as to be soldered on the second circuit board. When the first pins are inserted from the first front surface and pass through the first pin holes and the second pins are inserted from the second rear surface and pass through the second pin holes respectively, the first positioning block is accommodated in the first positioning opening, the second positioning block is propped against the second rear surface, so that a distance between the first plug hole and the first front surface of the first circuit board is a predetermined distance and a distance between the second plug hole and the second front surface of the second circuit is the predetermined distance.

In light of the above, according to the electrical connector and the electrical assembly of the embodiments, the electrical connector is disposed on the circuit board via the pins and positioned via the positioning block accommodated therein. Accordingly, no matter that the electrical connector is assembled to the circuit board from the front surface or the rear surface, both the plug hole of the electrical connector and the front surface of the circuit board are having the same distance. According to the electrical assembly of the embodiment, two circuit boards are disposed upside down to each other on the combined circuit board and the same two electrical connectors are simultaneously installed on the same side of the combined circuit board and respectively on the front surface and the rear surface of the circuit boards, so that the plug hole of each of the electrical connectors and their corresponding front surfaces of the circuit boards are having the same distance. Accordingly, the electrical assembly achieves the property which can unify the electronic components assembled thereto.

Several exemplary embodiments accompanied with figures are described in detail below to further describe the invention in details.

DETAILED DESCRIPTION OF DISCLOSED EXEMPLARY EMBODIMENTS

Figure 1:
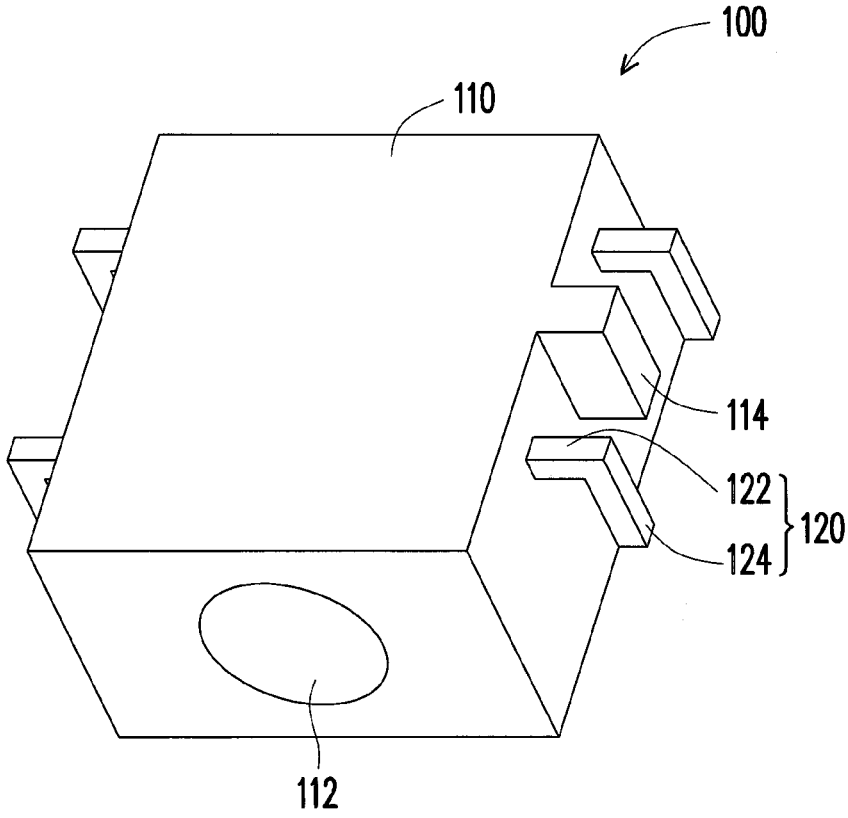
FIG. 1 is a perspective view illustrating an electrical connector according to an embodiment of the disclosure.
Figure 2:
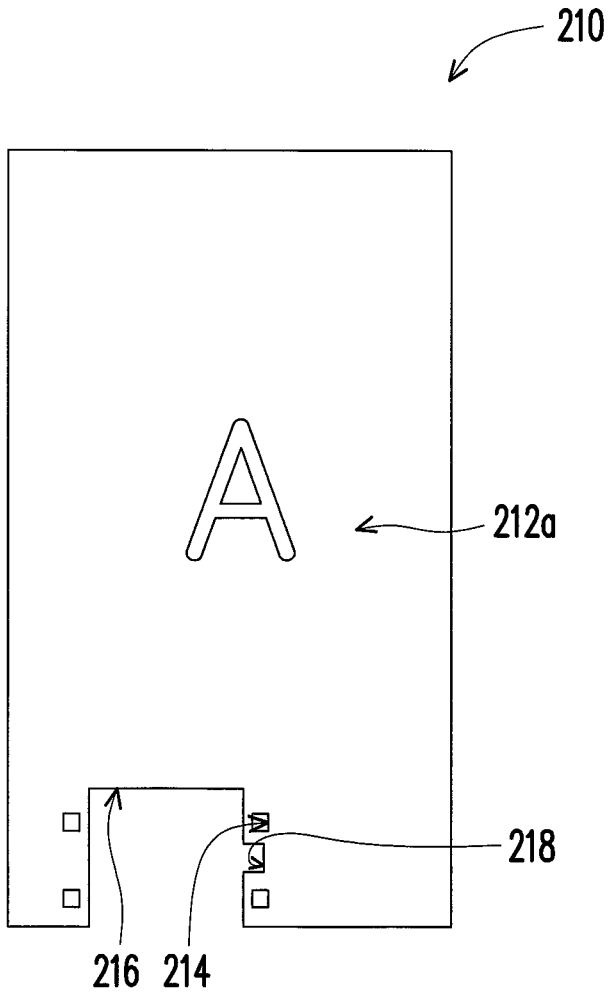
FIG. 2 is a top view of a circuit board for the electrical connector of FIG. 1.

FIG. 1 is a perspective view illustrating an electrical connector according to an embodiment of the disclosure. FIG. 2 is a top view of a circuit board for the electrical connector of FIG. 1. Referring to FIG. 1 and FIG. 2, in this embodiment, the electrical connector 100 is adapted to be installed on a circuit board 210. The circuit board 210 has a front surface 212*a*, a rear surface 212*b* opposite to the front surface 212*a*, a plurality of pin holes 214, an accommodating opening 216 and a positioning opening 218. The accommodating opening 216 is located at a side edge of the circuit board 210, and the positioning opening 218 is connected to the accommodating opening 216. For clearer illustration of the figures, in the figures of the embodiment, capital letter "A" is defined as "front surface" and capital letter "B" is defined as "rear surface", e.g., the front surface 212*a* of the circuit board 210 is shown with "A" in FIG. 2 and the rear surface 212*b* of the circuit board 210 is shown with "B" in FIG. 6.

Referring to FIG. 1 and FIG. 2, the electrical connector 100 includes a body 110 and a plurality of pins 120. The body 110 is adapted to be accommodated in the accommodating opening 216 of the circuit board 210 and has a plug hole 112 and a positioning block 114. The pins 120 extend from the body 110. More specifically, each of the pins 120 has an extending portion 122 extending from the body 110 and a passing portion 124 connected to the extending portion 122, and the pins 120 correspondingly pass through the pin holes 214 of the circuit board 210 via passing portions 124. Thus, position of the pins 120 and the pin holes 214 of the circuit board 210 have to correspond to each other so that the pins 120 can smoothly pass through the pin holes 214 of the circuit board 210. In the embodiment, the electrical connector 100 has four pins 120, and the circuit board 210 has four pin holes 214, in order that the pins 120 pass through the pin holes 214 respectively so as to be soldered on the circuit board 210. However, in other embodiment, the electrical connector 100 and circuit board 210 may be designed with appropriate amount of pins 120 and corresponding pin holes 214, and the disclosure is not limited thereto.

Figure 3A:
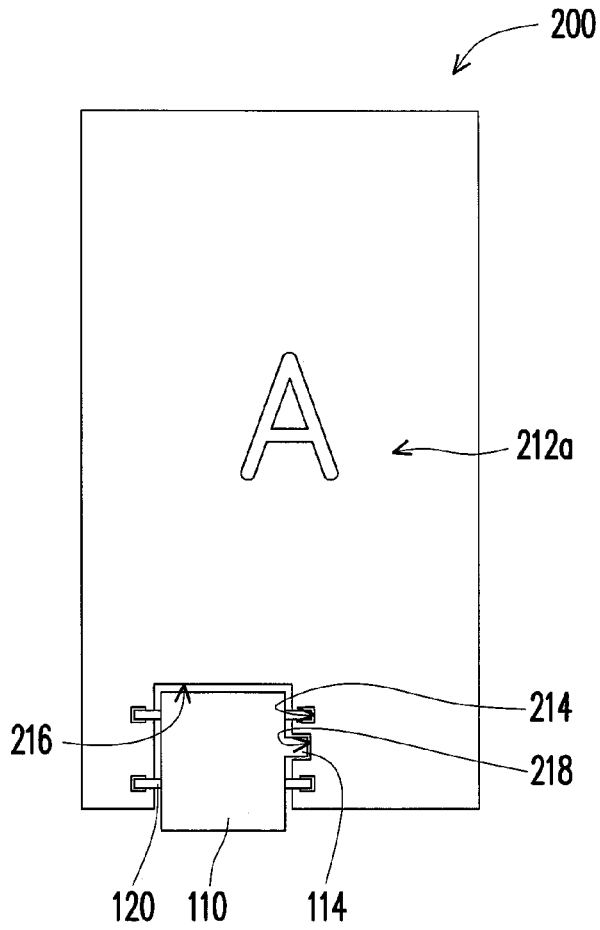
FIG. 3A is a top view illustrating the electrical connector of FIG. 1 is installed on the circuit board of FIG. 2 from the front surface of the circuit board.
Figure 3B:
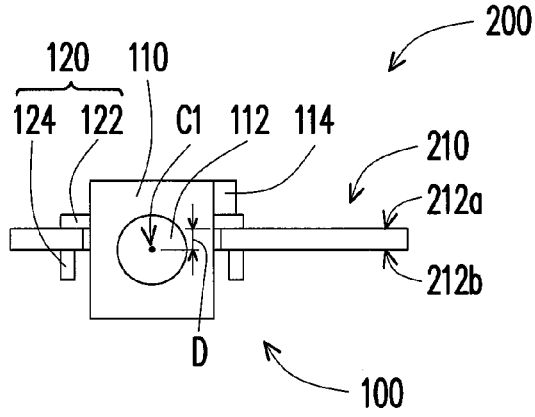
FIG. 3B is a front view of the electrical assembly of FIG. 3A.

FIG. 3A is a top view illustrating the electrical connector of FIG. 1 is installed on the circuit board of FIG. 2 from the front surface of the circuit board. FIG. 3B is a front view of the electrical assembly of FIG. 3A. Referring to FIG. 3A and FIG. 3B, another embodiment of the disclosure provides an electrical assembly 200 including the electrical connector 100 of FIG. 1 and the circuit board 210 of FIG. 2. In the embodiment, when the electrical connector 100 is disposed at the accommodating opening 216 of the circuit board 210 and the pins 120 are inserted from the front surface 212*a* and pass through the pin holes 214, the extending portions 122 are propped against the front surface 212*a*, and the passing portions 124 pass through the pin holes 214, and the positioning block 114 is accommodated in the positioning opening 218, so that a distance between the plug hole 112 and the front surface 212*a* of the circuit board 210 is a predetermined distance D. Under the condition of the extending portions 122 propping against the front surface 212*a*, the passing portions 124 of the pins 120 of the electrical connector 100 are soldered to the pin holes 214 of the circuit board 210 respectively.

Figure 4A:
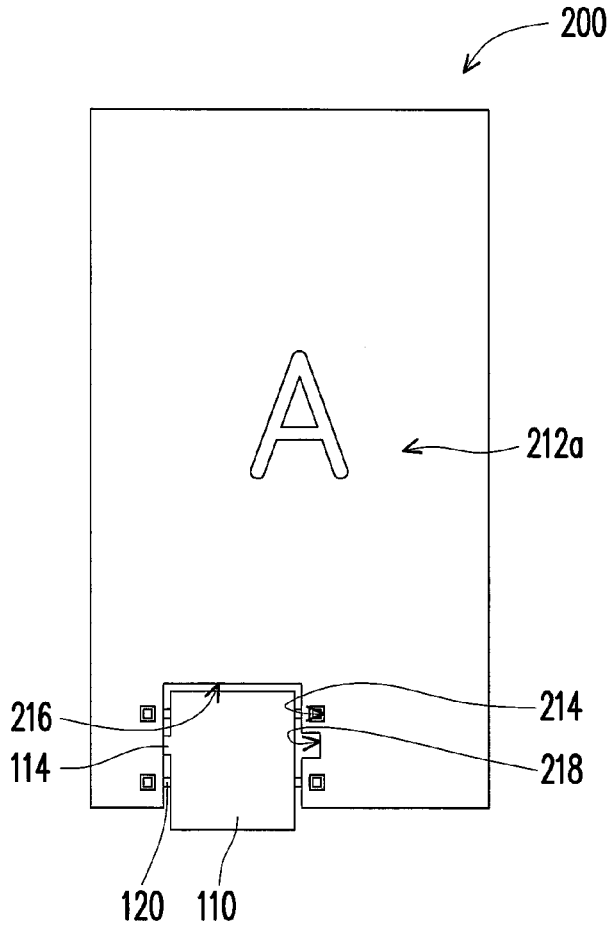
FIG. 4A is a top view illustrating the electrical connector of FIG. 1 is installed on the circuit board of FIG. 2 from the rear surface of the circuit board.
Figure 4B:
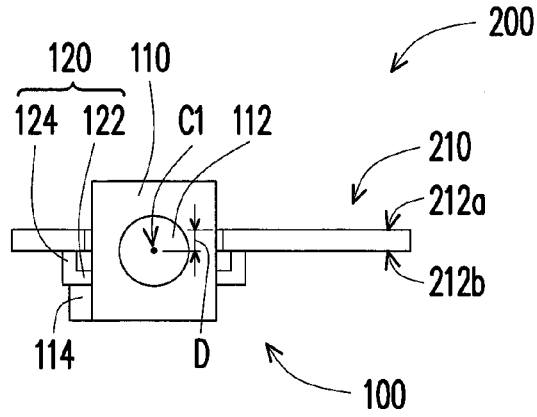
FIG. 4B is a front view of the electrical assembly of FIG. 4A.

On the other hand, FIG. 4A is a top view illustrating the electrical connector of FIG. 1 is installed on the circuit board of FIG. 2 from the rear surface of the circuit board. FIG. 4B is a front view of the electrical assembly of FIG. 4A. Referring to FIG. 4A and FIG. 4B, in the embodiment, when the electrical connector 100 is disposed at the accommodating opening 216 of the circuit board 210 and the pins 120 are inserted from the rear surface 212*b* and pass through the pin holes 214, the passing portions 124 pass through the pin holes 214, and the positioning block 114 replaces the extending portions 122 for propping against the rear surface 212*b*, so that a distance between the plug hole 112 and the front surface 212*a* of the circuit board 210 is the predetermined distance D. Under the condition of the positioning block 114 replacing the extending portions 122 to prop against the rear surface 212*b*, the passing portions 124 of the pins 120 of the electrical connector 100 are soldered to the pin holes 214 of the circuit board 210 respectively.

In brief, no matter the electrical connector 100 is assembled to the circuit board 210 from the front surface 212*a* or from the rear surface 212*b*, the plug hole 112 of the electrical connector 100 may keep the predetermined distance D from the front surface 212*a* of the circuit board 210.

Specifically, in the embodiment, the plug hole 112 is a circular plug hole, but in other embodiments, the plug hole 112 may be a rectangular plug hole or any other shape and the disclosure in not limited thereto.

Figure 5A:
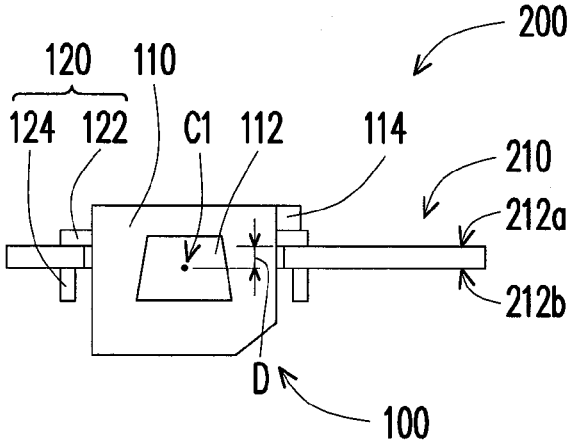
FIG. 5A is a front view illustrating an electrical connector is installed on a circuit board from the front surface of the circuit board according to another embodiment of the disclosure.
Figure 5B:
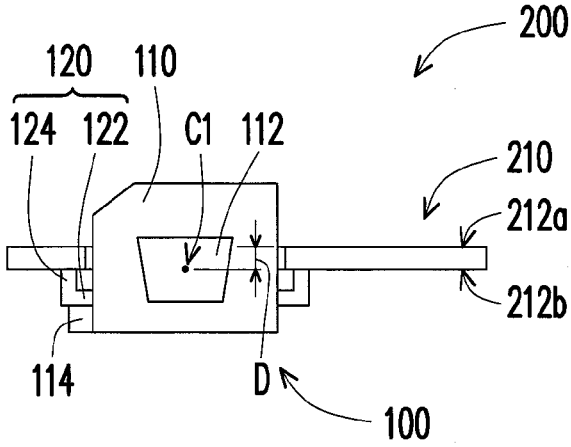
FIG. 5B is a front view illustrating an electrical connector is installed on a circuit board from the rear surface of the circuit board according to another embodiment of the disclosure.

FIG. 5A is a front view illustrating an electrical connector is installed on a circuit board from the front surface of the circuit board according to another embodiment of the disclosure. FIG. 5B is a front view illustrating an electrical connector is installed on a circuit board from the rear surface of the circuit board according to another embodiment of the disclosure. Referring to FIG. 5A and FIG. 5B, the plug hole 112 of the embodiment may be a trapezoid hole, and the plug holes 112 of FIG. 3B and FIG. 4B are circular holes.

In the aforementioned embodiments, each of the plug holes 112 with different shapes may have an outline reference point C1 for a reference datum of the distance. Thus, regarding the distance between the plug hole 112 and the front surface 212*a* of the circuit board 210, the distance between the outline reference point C1 of the plug hole 112 and the front surface 212*a* of the circuit board 210 can be defined as the predetermined distance D. Therefore, no matter the electrical connector 100 is assembled to the accommodating opening 216 of the circuit board 210 from the front surface 212*a* or from the rear surface 212*b*, the distance between the outline reference point C1 of the plug hole 112 of the electrical connector 100 and the front surface 212*a* is the predetermined distance D. In the embodiment, the outline reference point C1 of the plug hole 112 can be the center of shape of the plug hole 112, and the outline reference point C1 of the plug hole 112 can also be the midpoint of the widest width of the outline of the plug hole 112 when the outline of the plug hole 112 is perpendicular to the front surface 212*a*.

Figure 6:
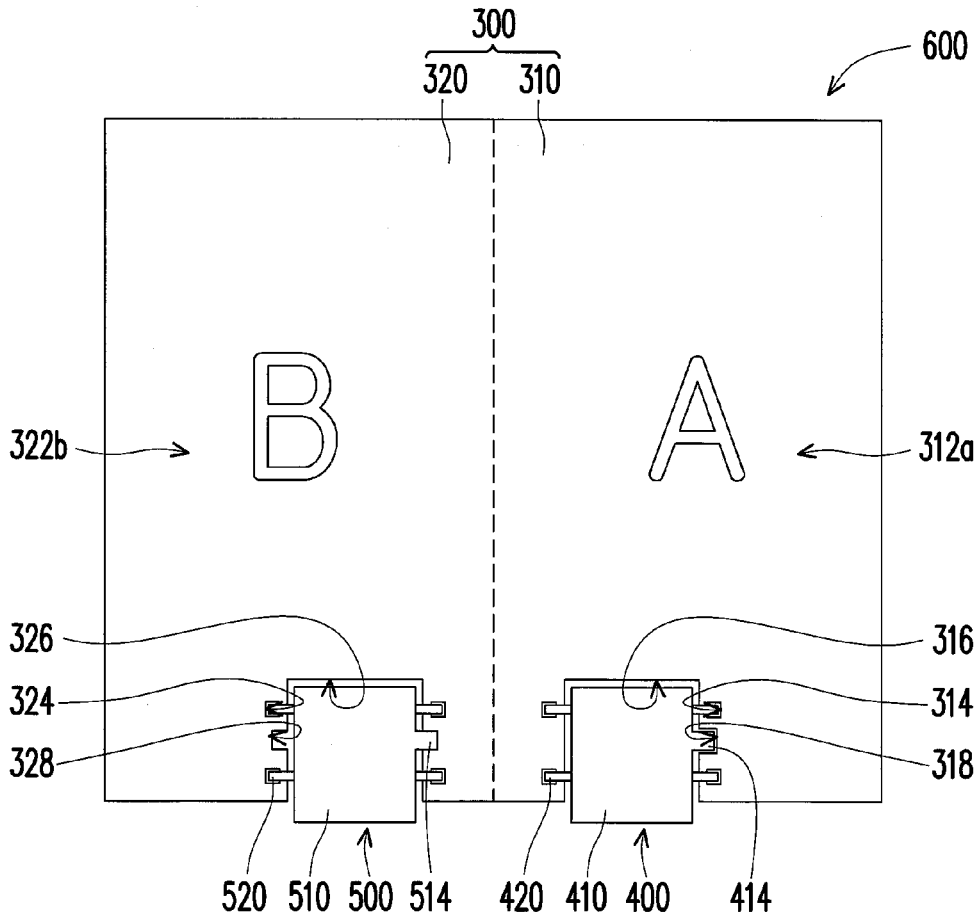
FIG. 6 is a top view illustrating an electrical assembly according to another embodiment of the disclosure.
Figure 7:
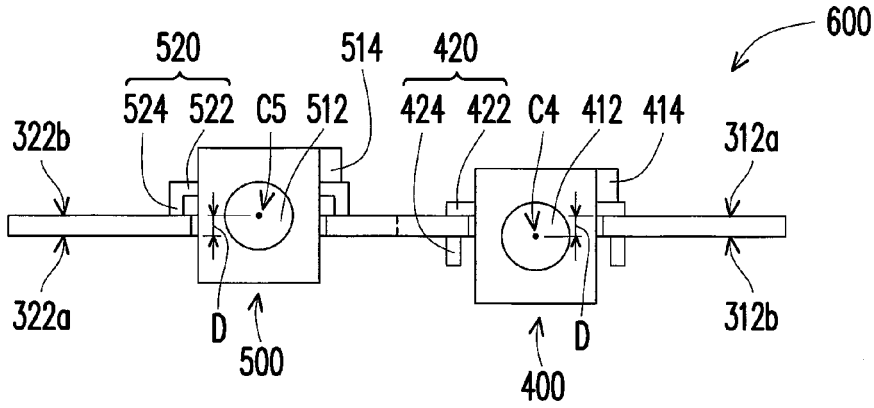
FIG. 7 is a front view of the electrical assembly of FIG. 6.

FIG. 6 is a top view illustrating an electrical assembly according to another embodiment of the disclosure. FIG. 7 is a front view of the electrical assembly of FIG. 6. Referring to FIG. 6 and FIG. 7, another embodiment of the disclosure provides an electrical assembly 600 including a combined circuit board 300, a first electrical connector 400 and a second electrical connector 500. The combined circuit board 300 includes a first circuit board 310 and a second circuit board 320. The first circuit board 310 has a first front surface 312*a*, a first rear surface 312*b* opposite to the first front surface 312*a*, a plurality of first pins 314, a first accommodating opening 316 and a first positioning opening 318, wherein the first accommodating opening 316 is located at a side edge of the first circuit board 310, and the first positioning opening 318 is connected to the first accommodating opening 316. The second circuit board 320 has a second front surface 322*a*, a first second side 322*b* opposite to the second front surface 322*a*, a plurality of second pins 324, a second accommodating opening 326 and a second positioning opening 328, wherein the second accommodating opening 326 is located at a side edge of the second circuit board 320, and the second positioning opening 328 is connected to the second accommodating opening 326.

More specifically, in the embodiment, the first circuit board 310 and the second circuit board 320 are the same, i.e., a circuit disposed on the first front surface 312*a* of the first circuit board 310 and a circuit disposed on the second front surface 322*a* of the second circuit board 320 are the same, and a circuit disposed on the first rear surface 312*b* of the first circuit board 310 and a circuit disposed on the second rear surface 322*b* of the second circuit board 320 are the same. It has to be noted that, in the combined circuit board 300, the second circuit board 320 is connected and upside down with respect to the first circuit board 310, i.e., the first front surface 312*a* of the first circuit board 310 and the second rear surface 322*b* of the second circuit 320 are coplanar, the first rear surface 312*b* of the first circuit board 310 and the second front surface 322*a* of the second circuit board 320 are coplanar, as shown in FIG. 7. In actual application, the combined circuit board 300 is the so-called mirror board, i.e., the combined circuit board 300 is formed by disposing the first circuit board 310 and the second circuit board 320 on the same substrate with their front surface and rear surface are upside down to each other. Accordingly, when electrical components are assembled to the combined circuit board 300, the electrical components can be assembled to the first circuit board 310 and the second circuit board 320 at the same time, so as to improve the assembling efficiency and cost down the electrical components.

Referring to FIG. 6 and FIG. 7 again, the first electrical connector 400 includes a first body 410 and a plurality of first pins 420. The first body 410 is accommodated in the first accommodating opening 316 of the first circuit board 310 and has a first plug hole 412 and a first positioning block 414. The first pins 420 extend from the first body 410, and more specifically, each of the first pins 420 has a first extending portion 422 extending from the first body 410 and a first passing portion 424 connected to the first extending portion 422, and the positions of the first pins 420 correspond to the positions of the first pin holes 314 respectively. Accordingly, the first pins 420 correspondingly pass through the first pin holes 314 via the first passing portions 424 so as to be soldered on the first circuit board 310. The second electrical connector 500, identical to the first electrical connector 400, includes a second body 510 and a plurality of second pins 520. The second body 510 is accommodated in the second accommodating opening 326 of the second circuit board 320 and has a second plug hole 512 and a second positioning block 514. The second pins 520 extend from the second body 510, and more specifically, each of the second pins 520 has a second extending portion 522 extending from the second body 510 and a second passing portion 524 connected to the second extending portion 522, and the positions of the second pins 520 correspond to the positions of the second pin holes 324 respectively. Accordingly, the second pins 520 correspondingly pass through the second pin holes 324 via the second passing portions 524 so as to be soldered on the second circuit board 320.

In the embodiment, the assembling method of the electrical assembly 600 is that the first electrical connector 400 and the second electrical connector 500 are respectively disposed on the first circuit board 310 and the second circuit board 320 of the combined circuit board 300, and in this assembling method the assembling process is performed to one side of the combined circuit board 300 simultaneously. However, as above mentioned, in the combined circuit board 300, the second circuit board 320 is connected and upside down with respect to the first circuit board 310, i.e., the first front surface 312*a* of the first circuit board 310 and the second rear surface 322*b* of the second circuit 320 are coplanar, the first rear surface 312*b* of the first circuit board 310 and the second front surface 322*a* of the second circuit board 320 are coplanar. Therefore, in the embodiment, when the first electrical connector 400 is disposed to the first circuit board 310 from the first front surface 312*a*, the second electrical connector 500 just can be disposed to the second circuit board 320 from the second rear surface 322*b*. In another embodiment, the electrical assembly 600 can also be reversely assembled, i.e., the first electrical connector 400 is disposed to the first circuit board 310 from the first rear surface 312*b*, and the second electrical connector 500 is disposed to the second circuit board 320 from the second front surface 322*a*.

Returning back to the embodiment, referring to FIG. 6 and FIG. 7 again, the first electrical connector 400 is disposed in the first accommodating opening 316 of the first circuit board 310 in order that when the first pins 320 are correspondingly inserted from the first front surface 312*a* and pass through the first pin holes 314; the first extending portions 422 are propped against the first front surface 312*a*; the first passing portions 424 pass through the first pin holes 314; the first positioning block 414 is accommodated in the first positioning opening 318; so that the distance between the first plug hole 412 and the first front surface 312*a* of the first circuit board 310 is the predetermined distance D, and the first electrical connector 400 is propped against the first front surface 312*a* via the first extending portions 422 and soldered to the first circuit board 310.

As mentioned above, at the same time when the first electrical connector 400 is disposed to the first circuit board 310, the second electrical connector 500 is disposed to the circuit board 320. The second electrical connector 500 is disposed in the second accommodating opening 326 of the second circuit board 320, in order that when the second pins 520 are inserted from the second rear surface 322*b* and pass through the second pin holes 324 respectively, the second passing portions 524 pass through the second pin holes 324, but the second extending portions 522 do not prop against the second front surface 322*a*. The second positioning block 514 is propped against the second rear surface 322*b* so that the distance between the second plug hole 512 and the second front surface 322*a* of the second circuit board 320 is the predetermined D, and the second electrical connector 500 is propped against the second rear surface 322*b* via the second positioning block 514 and soldered to the second circuit board 320.

Specifically, in the embodiment, the first plug hole 412 can be a circular plug hole. Since the first electrical connector 400 is the same as the second electrical connector 500, the second plug hole 512 can also be a circular plug hole. In other embodiments, the first plug hole 412 and the second plug hole 512 can be trapezoid plug holes as shown in FIG. 5A and FIG. 5B or other shape of holes, and the disclosure is not limited thereto. Thus, if the first plug hole 412 and the second plug hole 512 are different in shapes, the outline reference points C4 and C5 can be defined as the reference datums for the distance. Therefore, regarding the distance between the first plug hole 412 and the first front surface 312*a* of the first circuit board 310, the distance between the outline reference point C4 of the first plug hole 412 and the first front surface 312*a* of the first circuit board 310 can be defined as the predetermined distance D. And regarding the distance between the second plug hole 512 and the second front surface 322*a* of the second circuit board 320, the distance between the outline reference point C5 of the second plug hole 512 and the second front surface 322*a* of the second circuit board 320 can be defined as the predetermined distance D.

In the embodiment, the outline reference point C4 of the first plug hole 412 can be the center of shape of the first plug hole 412, and the outline reference point C5 of the second plug hole 512 can be the center of shape of the second plug hole 512. Or the outline reference point C4 of the first plug hole 412 can be the midpoint of the widest width of the outline of the first plug hole 412 when the outline of the first plug hole 412 is perpendicular to the first front surface 312*a*, and the outline reference point C5 of the second plug hole 512 can be the midpoint of the widest width of the outline of the second plug hole 512 when the outline of the second plug hole 512 is perpendicular to the second front surface 322*a*.

Referring to FIG. 7, after the first electrical connector 400 and the second electrical connector 500 of the electrical assembly 600 are disposed on the first circuit board 310 and the second circuit board 320 of the combined circuit board 300 respectively, the first electrical connector 400 and the second electrical connector 500 have different distances with one side of the combined circuit board 300 respectively, since the first positioning block 414 of the first electrical connector 400 is accommodated in the first positioning opening 318 and propped against the first front surface 312*a* of the first circuit board 310 via the first extending portions 422, whereas the second positioning block 514 of the second electrical connector 500 is propped against the second rear surface 322*b* of the second circuit board 320. As previously mentioned, in the combined circuit board 300, the first front surface 312*a* of the first circuit board 310 and the second rear surface 322*b* of the second circuit board 320 are coplanar, thus the first electrical connector 400 and the second electrical connector 500 have different distances with one side of the combined circuit board 300.

Figure 8:
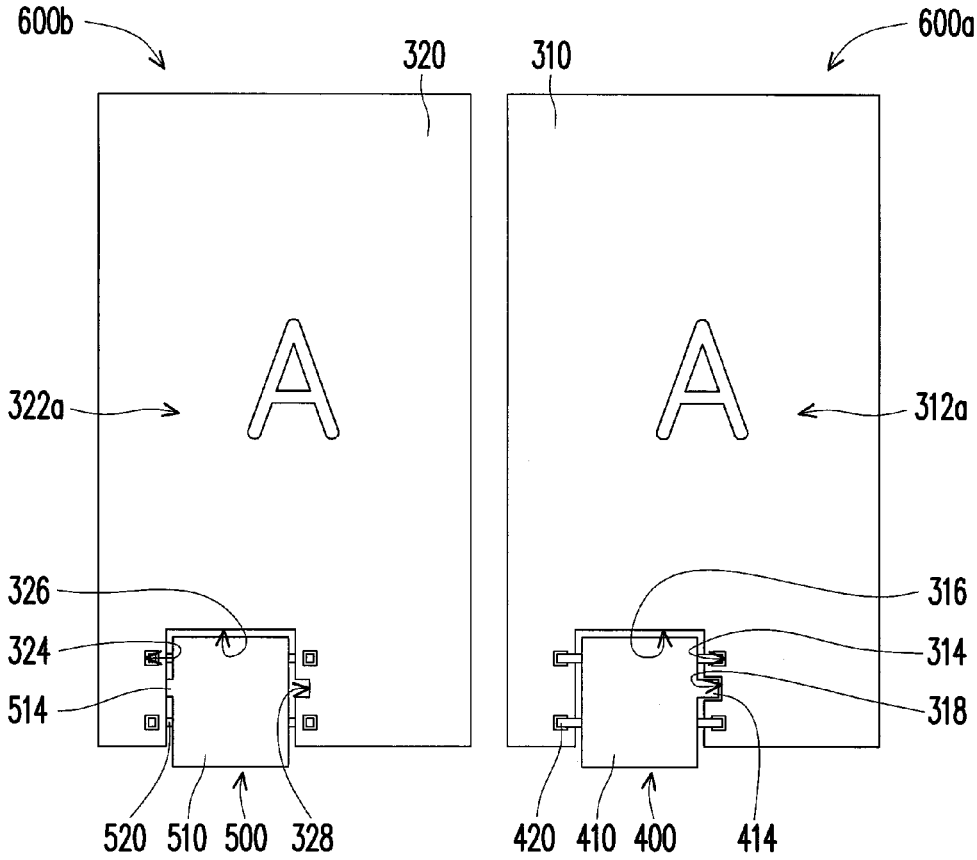
FIG. 8 is a top view of the front surface of the electrical assembly of FIG. 6 after cutting process.
Figure 9:
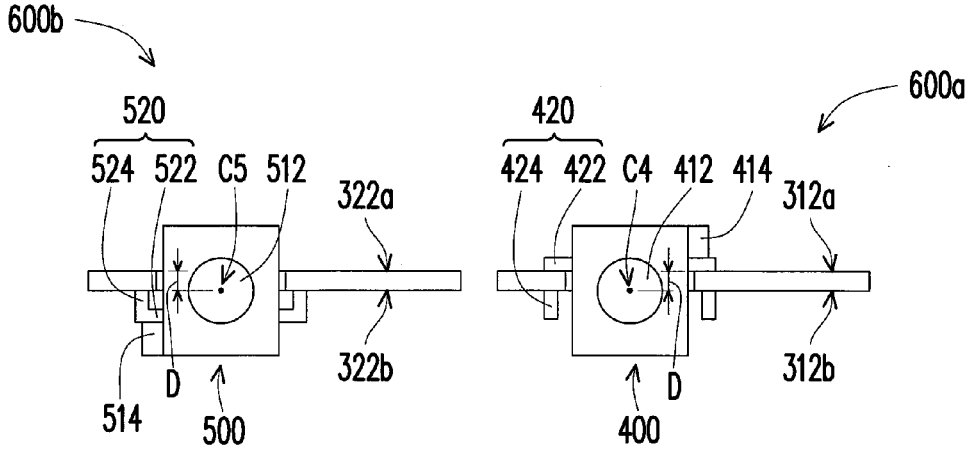
FIG. 9 is a front view of the electrical assembly of FIG. 8.

FIG. 8 is a top view of the front surface of the electrical assembly of FIG. 6 after cutting process. FIG. 9 is a front view of the electrical assembly of FIG. 8. Referring to FIG. 6, after the electrical assembly 600 is assembled, the combined circuit 300 can be separated into the first circuit board 310 and the second circuit board 320. When the electrical assembly 600 of FIG. 6 is cut and separated into the electrical assembly 600*a*, 600*b* and the electrical assembly 600*b* is turned over, then the electrical assembly 600*b* is the same as the electrical assembly 600*a*, as shown in FIG. 8. In the embodiment, the first circuit board 310 and the second circuit board 320 are identical circuit boards substantially. The first electrical connector 400 and the second electrical connector 500 are substantially identical electrical connectors. Thus, the electrical assembly 600 of the embodiment can be regarded as assembling process is performed to two electrical assemblies 600*a*, 600*b* at the same time, and the electrical assembly 600 can be separated into two independent electrical assemblies 600*a* and 600*b* after the assembling process.

Specifically, in FIG. 6, the first circuit board 310 and the second circuit board 320 are connected upside down to each other first, and then electrical components are assembled to the combined circuit 300. In the electrical assembly 600, the first electrical connector 400 is accommodated in the first accommodating opening 316 from the first front surface 312*a* of the first circuit board 310 and the second electrical connector 500 is accommodated in the second accommodating opening 326 from the second rear surface 322*b* of the second circuit board 320, so that the first electrical connector 400 and the second electrical connector 500 are substantially soldered to the first circuit board 310 and the second circuit board 320 via the different sides of the first circuit board 310 and the second circuit board 320.

Referring to FIG. 9, after the electrical assembly 600 is separated into the electrical assembly 600*a* and the electrical assembly 600*b*, the only difference between thereof is that the electrical components are assembled to the circuit boards in different directions. Even so, the outline reference point C4 of the first plug hole 412 and the outline reference point C5 of the second plug hole 512 respectively keep a distance of the predetermined distance D with the first front surface 312*a* of the first circuit board 310 and the second rear surface 322*b* of the second circuit board 320. Therefore, the electrical assembly 600*a* and the electrical assembly 600*b* have substantially identical structures.

When the electrical assembly 600*a* and the electrical assembly 600*b* are respectively disposed to adapted electronic devices, the relative position of the first plug hole 412 with respect to the electronic device and the relative position of the second plug hole 512 with respect to the electronic device may be equivalent, i.e., the electrical assembly 600*a* and the electrical assembly 600*b* can provide electrical connectors having the same function in the corresponding positions of the electronic device. Therefore, the electrical assembly 600*a* and the electrical assembly 600*b* obtained after the electrical assembly 600 is assembled are different in the assembling directions when the first electrical connector 400 and the second electrical connector 500 are respectively assembled to the first circuit board 310 and the second circuit board 320, but the appearances and functions thereof are the same, and thus assembling efficiency can be improved and the manufacturing cost can be reduced.

In light of the foregoing, according to the electrical connector and the electrical assembly of the embodiment of the disclosure, the body of the electrical connector is disposed in the accommodating opening of the circuit board and soldered to the circuit board by means of the pins of the electrical connector passing through the pin holes of the circuit board. When the electrical connector is installed on the circuit board from the front surface of the circuit board, the positioning block is accommodated in the positioning opening and the extending portions of the pins are propped against the front surface of the circuit board. On the contrary, when the electrical connector is installed on the circuit board from the rear surface of the circuit board, the positioning block replaces the extending portions of the pins for propping against the rear surface of the circuit board. Accordingly, no matter that the electrical connector is assembled to the circuit board from the front surface or the rear surface, the distances between the plug hole of each of the electrical connectors and the front surface of the circuit board are the same.

Moreover, according to the electrical assembly of the embodiment of the disclosure, the two circuit boards are disposed to the same substrate and connected upside down to each other to form a combined circuit board for assembling process. The two identical electrical connectors are respectively disposed on the two circuit boards from the same side of the combined circuit board. And substantially, the electrical connectors are respectively disposed on two opposite sides of the circuit boards (one on the front surface of the circuit board, and the other on the rear surface of another circuit board), but the predetermined distances of the plug hole of each electrical connector between the corresponding front surface of the circuit board are the same. Though the two identical electrical connectors are installed to the two circuit boards from two different sides (i.e., front surface and rear surface) of the two circuit boards, the positions of the plug holes of the electrical connectors with respect to the corresponding circuit board are the same. Thus, the electrical assembly of the embodiment of the disclosure has the property which can unify the electronic components assembled thereto, and the assembling efficiency can be improved and the manufacturing cost can be reduced.

It will be apparent to those skilled in the art that various modifications and variations can be made to the structure of the disclosure without departing from the scope or spirit of the invention. In view of the foregoing, it is intended that the disclosure cover modifications and variations of this invention provided they fall within the scope of the following claims and their equivalents.

What is claimed is:

1. An electrical connector, adapted to be installed on a circuit board, the circuit board having a front surface and a rear surface opposite to the front surface, a plurality of pin holes, an accommodating opening and a positioning opening, the electrical connector comprising:

a body adapted to be accommodated in the accommodating opening of the circuit board and having a plug hole and a positioning block; and a plurality of pins extending from the body and adapted to pass through the pin holes respectively so as to be soldered to the circuit board, wherein when the pins are inserted from the front surface and pass through the pin holes respectively, the positioning block is accommodated in the positioning opening so that a distance between the plug hole and the front surface of the circuit board is a predetermined distance, and when the pins are inserted from the rear surface and pass through the pin holes respectively, the positioning block is propped against the rear surface so that a distance between the plug hole and the front surface of the circuit board is the predetermined distance.

2. The electrical connector as claimed in claim 1, wherein the predetermined distance is a distance between an outline reference point of the plug hole and the front surface of the circuit board.

3. The electrical connector as claimed in claim 2, wherein the outline reference point of the plug hole is a center of shape of the outline of the plug hole.

4. The electrical connector as claimed in claim 2, wherein the outline reference point of the plug hole is a midpoint of a largest width of the outline of the plug hole when the outline of the plug hole is perpendicular to the front surface of the circuit board.

5. The electrical connector as claimed in claim 1, wherein each of the pins has an extending portion extending from the body and a passing portion connected to the extending portion, and the passing portions are correspondingly passing through the pin holes, when the pins are inserted from the front surface and pass through the pin holes respectively and the positioning block is accommodated in the positioning opening, the extending portions are propped against the front surface, and when the pins are inserted from the rear surface and pass through the pin holes respectively and the positioning block is propped against the rear surface, the extending portions are not propped against the front surface.

6. An electrical assembly, comprising:

a circuit board having a front surface, a rear surface opposite to the front surface, a plurality of pin holes, an accommodating opening and a positioning opening; and an electrical connector, comprising:

a body adapted to be accommodated in the accommodating opening of the circuit board and having a plug hole and a positioning block; and a plurality of pins extending from the body and passing through the pin holes respectively so as to be soldered to the circuit board, wherein when the pins are inserted from the front surface and pass through the pin holes respectively, the positioning block is accommodated in the positioning opening so that a distance between the plug hole and the front surface of the circuit board is a predetermined distance, and when the pins are inserted from the rear surface and pass through the pin holes respectively, the positioning block is propped against the rear surface so that a distance between the plug hole and the front surface of the circuit board is the predetermined distance.

7. The electrical assembly as claimed in claim 6, wherein the accommodating opening is located at a side edge of the circuit board, and the positioning opening is connected to the accommodating opening.

8. The electrical assembly as claimed in claim 6, wherein the predetermined distance is a distance between an outline reference point of the plug hole and the front surface of the circuit board.

9. The electrical assembly as claimed in claim 8, wherein the outline reference point of the plug hole is a center of shape of the outline of the plug hole.

10. The electrical assembly as claimed in claim 8, wherein the outline reference point of the plug hole is a midpoint of a largest width of the outline of the plug hole when the outline of the plug hole is perpendicular to the front surface of the circuit board.

11. The electrical assembly as claimed in claim 6, wherein each of the pins has an extending portion extending from the body and a passing portion connected to the extending portion, and the passing portions are correspondingly passing through the pin holes, when the pins are inserted from the front surface and pass through the pin holes respectively and the positioning block is accommodated in the positioning opening, the extending portions are propped against the front surface, and when the pins are inserted from the rear surface and pass through the pin holes respectively and the positioning block is propped against the rear surface, the extending portions are not propped against the front surface.

12. An electrical assembly, comprising:

a combined circuit board, comprising:

a first circuit board having a first front surface, a first rear surface opposite to the first front surface, a plurality of first pin holes, a first accommodating opening and a first positioning opening; and a second circuit board having a second front surface, a second rear surface opposite to the second front surface, a plurality of second pin holes and a second accommodating opening, wherein the second circuit board is upside down with respect to the first circuit board, the first front surface of the first circuit board and the second rear surface of the second circuit are coplanar, the first rear surface of the first circuit board and the second front surface of the second circuit board are coplanar, a circuit of the first circuit board disposed on the first front surface and a circuit of the second circuit board disposed on the second front surface are the same, and a circuit of the first circuit board disposed on the first rear surface and a circuit of the second circuit board disposed on the second rear surface are the same;

a first electrical connector, comprising:

a first body accommodated in the first accommodating opening of the first circuit board and having a first plug hole and a first positioning block; and a plurality of first pins extending from the first body and passing through the first pins respectively so as to be soldered on the first circuit board; and a second electrical connector, identical to the first electrical connector, the second electrical connector comprising:

a second body accommodated in the second accommodating opening of the second circuit board and having a second plug hole and a second positioning block; and a plurality of second pins extending from the second body and passing through the second pins respectively so as to be soldered on the second circuit board, wherein when the first pins are inserted from the first front surface and pass through the first pin holes and the second pins are inserted from the second rear surface and pass through the second pin holes respectively, the first positioning block is accommodated in the first positioning opening, the second positioning block is propped against the second rear surface, so that a distance formed between the first plug hole and the first front surface of the first circuit board is a predetermined distance and a distance between the second plug hole and the second front surface of the second circuit is the predetermined distance.

13. The electrical assembly as claimed in claim 12, wherein the first circuit board and the second circuit board are the same, and the second circuit board has a second positioning opening.

14. The electrical assembly as claimed in claim 13, wherein the second accommodating opening is located at a side edge of the second circuit board, and the second positioning opening is connected to the second accommodating opening.

15. The electrical assembly as claimed in claim 12, wherein the first accommodating opening is located at a side edge of the first circuit board, and the first positioning opening is connected to the first accommodating opening.

16. The electrical assembly as claimed in claim 12, wherein the predetermined distance is a distance between an outline reference point of the first plug hole and the first front surface of the first circuit board, and the predetermined distance is a distance between an outline reference point of the second plug hole and the second front surface of the second circuit board.

17. The electrical assembly as claimed in claim 16, wherein the outline reference point of the first plug hole is a center of shape of the outline of the first plug hole, and the outline reference point of the second plug hole is a center of shape of the outline of the second plug hole.

18. The electrical assembly as claimed in claim 16, wherein the outline reference point of the first plug hole is a midpoint of a largest width of the outline of the first plug hole when the outline of the first plug hole is perpendicular to the first front surface of the first circuit board, and the outline reference point of the second plug hole is a midpoint of a largest width of the outline of the second plug hole when the outline of the second plug hole is perpendicular to the second front surface of the second circuit board.

19. The electrical assembly as claimed in claim 12, wherein each of the first pins has a first extending portion extending from the first body and a first passing portion connected to the first extending portion, the first passing portions pass through the first pin holes respectively, the first extending portions are propped against the first front surface, each of the second pins has a second extending portion extending from the second body and a second passing portion connected to the second extending portion, the second passing portions pass through the second pin holes respectively, and the second extending portions are not propped against the second front surface.

* * * * *